US008857864B2

(12) United States Patent
Snyder, Jr. et al.

(10) Patent No.: US 8,857,864 B2
(45) Date of Patent: Oct. 14, 2014

(54) TAMPER PROOF LOCK AND METHOD

(75) Inventors: Ronald T. Snyder, Jr., Solvay, NY (US); Reuben M. Snyder, Solvay, NY (US); Andre L. Dupra, Gates, NY (US)

(73) Assignees: Ronald T. Snyder, Jr., Solvay, NY (US); Reuben M. Snyder, Solvay, NY (US)

( * ) Notice: Subject to any disclaimer, the term of this patent is extended or adjusted under 35 U.S.C. 154(b) by 544 days.

(21) Appl. No.: 13/185,132

(22) Filed: Jul. 18, 2011

(65) Prior Publication Data

US 2013/0020812 A1 Jan. 24, 2013

(51) Int. Cl.
*E05B 17/20* (2006.01)

(52) U.S. Cl.
CPC ..... *E05B 17/2003* (2013.01)
USPC ..... 292/145; 292/346

(58) Field of Classification Search
USPC ..... 292/145
See application file for complete search history.

(56) References Cited

U.S. PATENT DOCUMENTS

| | | | | | |
|---|---|---|---|---|---|
| 3,312,490 | A | * | 4/1967 | MacDonald | 292/153 |
| 4,143,529 | A | * | 3/1979 | Brummett et al. | 70/152 |
| 4,372,594 | A | * | 2/1983 | Gater | 292/1.5 |
| 4,379,577 | A | * | 4/1983 | Robertson | 292/341.15 |
| 4,940,269 | A | * | 7/1990 | Kim | 292/337 |
| 5,316,353 | A | * | 5/1994 | McKernan | 292/337 |

* cited by examiner

*Primary Examiner* — Mark Williams
(74) *Attorney, Agent, or Firm* — Tracy Jong Law Firm; Tracy P. Jong; Cheng Ning Jong

(57) ABSTRACT

A tamper proof lock mountable to a door and configured to functionally cooperate with a strike plate having a hole that is mounted to a portion of a door frame. The lock comprises a wedge bolt having an oblique surface configured to cooperate with the strike plate. The wedge bolt is configured to be inserted in the hole to retain the door in its closed position. A shield is provided and configured to cooperate with the wedge bolt such that the oblique surface of the wedge bolt is rendered inaccessible when the wedge bolt is disposed in the hole of the strike plate and the oblique surface of the wedge bolt is exposed in anticipation for interaction with the strike plate when the door is not disposed in the closed position.

4 Claims, 7 Drawing Sheets

TAMPER PROOF LOCK AND METHOD

BACKGROUND OF THE INVENTION

1. The Field of the Invention

The present invention is directed generally to a tamper proof lock and more particularly to a tamper proof lock having a shield which cooperates with a wedge bolt to replace the use of a dead bolt.

2. Background Art

Numerous locks have been attempted in the past to facilitate access control of a space or properly isolate adjacent spaces. While locks can easily be designed to deter or prevent break-ins, the overwhelming majority of usable locks are designed with ease-of-use and fire safety in mind. In case of emergency, an occupant of a room which has been locked against access from the outside has to serve as an egress. Therefore, while a door can be heavily locked, the ease to unlock is of utmost importance for safety and convenience.

Dead bolts may be integrally or externally mounted to doors or door frames. In a typical installation, cavities are machined into a vertical edge of a door frame and a vertical edge and front and back faces of a corresponding door to accommodate a door lock and/or a dead bolt. A dead bolt is conventionally a separately installed unit and therefore requires its own set of cavities for installation.

Thus, there arises a need for a tamper proof lock that is universally adaptable to existing conventional door lock installations, simple to install, and can be installed without making modifications to existing door lock installations. It is also advantageous to provide a tamper proof lock that does not require professional installation, and is economically manufactured with less parts and no significant increase in materials cost.

SUMMARY OF THE INVENTION

The present invention is directed toward a tamper proof lock mountable to a door having a door frame and a strike plate having a hole, wherein the strike plate is mounted to a portion of the door frame. The lock comprises a wedge bolt having an oblique surface configured to cooperate with a strike plate having a hole, wherein the wedge bolt is configured to be inserted in the hole to retain the door in its closed position. A shield is configured to cooperate with the wedge bolt such that the oblique surface of the wedge bolt is rendered inaccessible when the wedge bolt is disposed in the hole of the strike plate.

The present invention is further directed to a method for preventing tampering of a door lock having a wedge bolt and a shield, wherein the door lock is mountable to a door having a door frame and a strike plate having a hole and the wedge bolt having an oblique surface. The method comprises the steps of extending the wedge bolt into the hole to engage the hole and complementing the oblique surface of the wedge bolt to prevent insertion of an object to engage the oblique surface of the wedge bolt.

Accordingly, it is a primary object of the present invention to provide a door lock which is tamper proof against attempts to compromise its wedge bolt.

It is another object of the present invention to provide a tamper proof lock which is a direct replacement to a conventional wedge bolt-type lock.

It is yet a further object of the present invention to provide a tamper proof lock which replaces or bolsters the functionality of a conventional dead bolt.

It is yet a further object of the present invention to provide security at a level similar to a conventional dead bolt while providing simple and intuitive operations to enable egress of its user when necessary.

It is yet a further object of the present invention to provide a tamper proof lock which saves installation labor and materials costs due to its ability to replace the use of an additional dead bolt to bolster security.

It is yet a further object of the present invention to provide a tamper proof lock that is universally adaptable to existing conventional door lock installations.

It is yet a further object of the present invention to provide a tamper proof lock that is simple to install, does not require professional installation and can be installed without making modifications to existing door lock installations.

It is also advantageous to provide a tamper proof lock that is economically manufactured with less parts and no significant increase in materials cost.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

Figure 1:
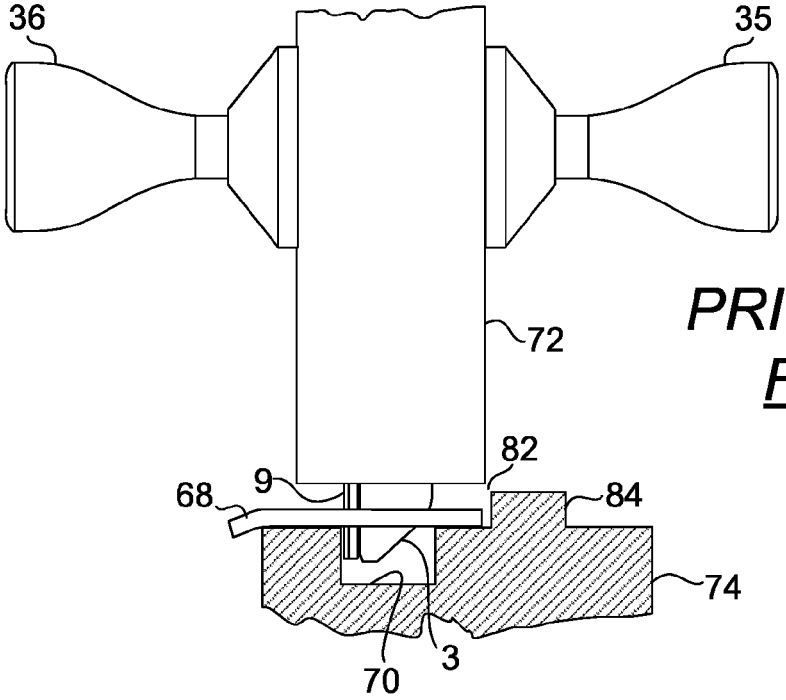
PRIOR ART FIG. 1
FIG. 1 is a partial plan view depicting a door equipped with a conventional lock having a prior art wedge bolt.

The drawings are not to scale, in fact, some aspects have been emphasized for a better illustration and understanding of the written description.

PARTS LIST

1—pin connecting horizontal bar to wedge bolt
2—lock
3—prior art wedge bolt
4—wedge bolt
5—retainer
6—wedge bolt arm
7—oblique surface of wedge bolt
8—shield
9—prior art trigger
10—shield spring seat
11—pin
12—recess
13—aperture where horizontal bar pivots
14—horizontal bar
15—guide slot in horizontal bar to allow triggering of pawl rocker when the wedge bolt strikes a strike plate
16—rocker
17—hump
18—rocker horn
19—pivotal connection between horizontal bar and rocker
20—rocker pin
21—pivotal connection between rocker and pawl rocker
22—pin
23—aperture for receiving pin 11
24—aperture for receiving pin 22
25—aperture of rocker for receiving pin 22
26—pawl rocker
27—spring locator
28—pawl
29—aperture of pawl rocker for receiving pin 22
30—ramp of pawl rocker
31—spring locator
32—stationary block
33—door knob support post
34—through hole of stationary block for accommodating door knob support post
35—outside door knob
36—inside door knob
38—door knob actuator
39—exposed end of lock sleeve
40—lock sleeve
41—proximal end of lock sleeve
42—aperture of lock sleeve for accommodating door knob support post
43—distal end of lock sleeve
44—aperture of lock sleeve for accommodating door knob actuator
46—threaded aperture for receiving screw which secures stationary block to lock sleeve
48—retractor
50—retractor plate
51—pin connecting retractor plates
52—through slot of stationary block for receiving retractor plate
54—aperture of retractor plate to allow support posts to go through
56—hook of retractor for coupling to rocker pin
58—aperture of retractor plate for receiving door knob actuator
60—wedge bolt spring
62—shield spring
64—horizontal bar return spring
66—retractor spring
67—slot of receiving retractor spring 66
68—strike plate
69—pin for fixedly securing retractor plates 50
70—hole of door frame for receiving a wedge bolt
71—groove for receiving pawl rocker
72—door
73—slot for receiving shield spring
74—door frame
75—slot for receiving spring 60
76—card
77—longitudinally disposed slot of stationary block for receiving arm and retainer
78—direction in which card is inserted
80—direction in which wedge bolt is retracted
82—gap between door and door frame
84—ridge
86—cavity made in door to accommodate lock
88—face plate
90—aperture for receiving screw that threads into threaded aperture 46
92—direction in which door knob actuator is rotated
94—clearance for accommodating support post
96—direction in which force is exerted by strike plate on wedge bolt
98—front end of stationary block
100—rear end of stationary block
102—recessed portion of stationary block
104—recessed portion of wedge bolt

PARTICULAR ADVANTAGES OF THE INVENTION

The present tamper proof lock enables the use of existing cavities already created in doors and door frames for conventional door locks. Rather than creating new cavities in both a door and its corresponding door frame to accommodate a conventional dead bolt, a conventional door lock is simply removed and replaced with a present tamper proof lock. This provides a reduced cost installation procedure or eliminates the need for a professional retrofit installation.

The present tamper proof lock mimics the function of a dead bolt and eliminates the need for a conventional dead bolt to provide added security. A dead bolt adds additional cost and labor to install and can be unsightly, especially one which is mounted externally on an exterior surface of a door or door frame. A conventional door lock comes in two major components, i.e., the lock portion and the door knobs and can be disposed in a locked or unlocked position. One of the door knobs is keyed and typically disposed on the side of the door for which access control is intended. In the unlocked position, a door knob can be freely rotated. In the locked position, the keyed door knob is locked or prevented from rotation. However, the wedge bolt of the lock portion may be depressed and retracted if access to it is gained. The present tamper proof lock eliminates the possibility of this access and therefore carries the function of a dead bolt.

The present tamper proof lock operates according to the operation of conventional door locks. In order to open an unlocked door, one simply rotates a door knob or lever operably connected to a wedge bolt. In order to close a locked or unlocked door, one simply pushes the door against a strike plate mounted on a door frame. A user does not need to re-learn the way to use the present tamper proof lock. The widespread use of conventional door locks makes coping with door locks requiring one or more additional steps counter-intuitive and not easily accepted.

The present tamper proof lock is simple and intuitive to operate and it eliminates a step required to unlock a dead bolt (for which it is designed to replace) in a dead bolt equipped door. However, for added security, a dead bolt may still be used without requiring one or more additional steps for operating the present tamper proof lock.

In order to be tamper proof, a traditional door lock relies on tight installation of a door frame against the edge of a door to leave no room for insertion of a foreign object into the gap between the door frame and the door. Typically a minimum gap of ¼ inch is sufficient for tampering. Over time, doors which are initially installed without excessive gaps between the doors and door frames can suffer from deterioration in their installation due to foundation settling of a structure to which the doors and door frames are installed. Incorrect sizing of doors further adds to the gaps created between doors and their respective door frames. The present tamper proof lock eliminates concerns of imperfect door lock installations.

DETAILED DESCRIPTION OF A PREFERRED EMBODIMENT

In the remainder of this specification, applicants will describe an embodiment which, preferably is a tamper proof lock having a wedge bolt that is mountable to a door and includes an oblique surface configured to cooperate with a strike plate and a shield configured to cooperate with the wedge bolt such that the oblique surface of the wedge bolt is rendered inaccessible when the wedge bolt is disposed in the hole of a door frame. The wedge bolt is configured to be inserted in a hole of a door frame to retain the door in its closed position. It shall be apparent, upon reading this disclosure in this entirety that, although the present lock is described in the context of contrasting the present lock with a conventional arrangement of a lock mounted to a door that cooperates with a strike plate mounted on a door frame and a hole provided in the door frame, the present lock is capable of other arrangements provided that the basic relationship of the wedge bolt, the strike plate and the hole remains.

In conjunction with a lock apparatus to prevent tampering, a method for preventing tampering of a door lock having a wedge bolt is also disclosed. The method comprises the steps of extending the wedge bolt into the hole to engage the hole and complementing the oblique surface of the wedge bolt to prevent insertion of an object to engage the oblique surface of the wedge bolt. The oblique surface of the wedge bolt is typically the result of machining an elongated bolt at an angle to one end of the bolt to result in this additional surface. The term "complementing," as used in this disclosure, means making whole the primary shape of the wedge bolt which is typically a cylinder with circular, oblong or rectangular profile in order to temporarily remove this additional surface. The method further comprises the steps of removing the shield to a retracted position from the hole and retaining the shield in the retracted position such that the door can be removed from engagement with the hole and that the wedge bolt can re-engage the hole. One advantage of preventing tampering in such a manner lies in the interchangeability of the present lock with a conventional lock as the present lock is compact and fits within the cavities already provided for the conventional lock.

Although not shown, it shall be appreciated that a shield that is separately actuated and configured to act as a barrier for access to the oblique surface of a wedge bolt may also be used.

The aforementioned embodiment and its contrast to a conventional lock will be described in the remainder of this specification FIG. 1 is a partial plan view depicting a door equipped with a conventional lock having a prior art wedge bolt 3 and a trigger 9. A door 72 is shown in its closed position with the wedge bolt 3 in its extended position and disposed in a hole 70 created in a door frame 74. A ridge 84 is typically provided to act as a stop for a closing door 72, a blockage to prevent tampering attempts and to provide enhanced seal around the periphery of the door 72 in order to reduce thermal transfer between the outside and inside spaces. A strike plate 68 provides a strike surface to guide the wedge bolt that is springingly engaged with the lock mechanism. While closing the door and as the wedge bolt 3 contacts the strike plate 68, the wedge bolt 3 retracts as it momentarily engages the strike plate before reaching a hole in the strike plate 68 which aligns with the hole 70 in the door frame 74. The oblique surface of the wedge bolt 3 minimizes the impact of the contact and provides for smooth retraction of the wedge bolt 3. In the unlocked position, a turn of the outside 35 or inside knobs 36 causes the wedge bolt 3 to retract to a point where it substantially clears the strike plate 68 so that the door 72 can be opened. The outside knob is typically locked or unlocked with a key while the inside lock is locked with a pushbutton or the like. It shall be noted that a lock at either one of the door knobs 35, 36 immobilizes the knob itself and not the wedge bolt 3. Although not shown, the present tamper proof lock is applicable to an electronic door where the operation of the outside knob is controlled by an optical or magnetic key card. A gap 82 can form between the door frame 74 and the door 72 regardless of whether the door has been professionally installed. As the installation deteriorates or as the installation is improperly completed, the gap 82 left behind may be sufficiently large for insertion of a card type material such as a credit card and the like. In some cases, the ridge 84 itself may be compromised to produce a larger gap 82.

Figure 2:
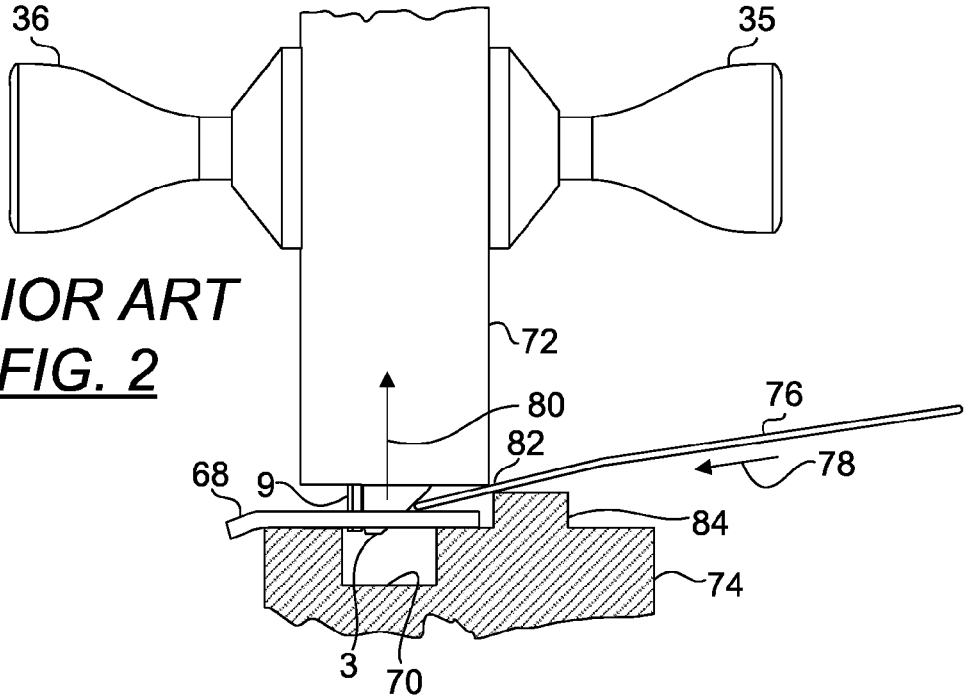
PRIOR ART FIG. 2
FIG. 2 is a partial plan view depicting a door equipped with a conventional lock having a prior art wedge bolt and a method by which the lock is compromised.

FIG. 2 is a partial plan view depicting a door equipped with a conventional lock having a prior art wedge bolt and a method by which the lock is compromised. As previously disclosed, a gap 82 between the door and the ridge 84 provides an opportunity for tampering. As depicted, a card 76 can be inserted in direction 78 within the gap 82 to contact and force against the oblique surface of the wedge bolt 3 causing it to retract in direction 80 to a point where it completely clears the strike plate 68. At this point, the door 72 can be simply pushed towards the inside space of the door 72 in order to open the door 72. The ridge 84 may alternately be enlarged to protrude further into the space delineated by the door frame 74 to increase the amount of effort required to tamper with the lock, however this practice is undesirable as this practice reduces the opening delineated by the door frame 74.

Figure 3:
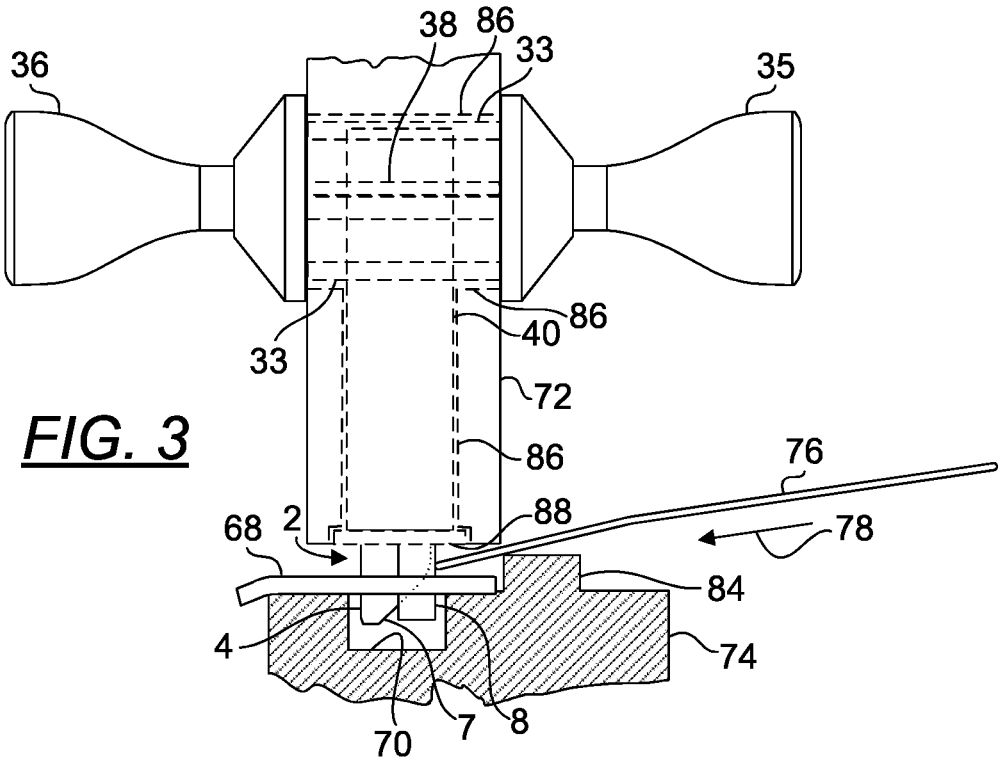
FIG. 3 is a partial plan view depicting a door equipped with one embodiment of the present lock and how the lock prevents tampering.

FIG. 3 is a partial plan view depicting a door equipped with one embodiment of the present lock and how the lock prevents tampering. Contrary to the access provided to the oblique surface of the wedge bolt in the prior art lock installation, the access is completely eliminated with the use of a shield 8 in the present lock 2. The present lock 2 is configured to be installed in existing installations. As examples, the present lock is a direct replacement for the following locks: Defiant Stainless Steel Brandywine Keyed Entry Knob Part No. 154-644, Schlage SecureKey Model No. F51 SK V BEL 505 605 and Kwikset 740LL Signature Series Lido Keyed Entry Door Lever Set. The cavities 86, 70 constructed in a door or door frame for mounting any one of these locks require no modification.

The novel concept of eliminating access to the oblique surface of a wedge bolt according to the present invention while its corresponding door is in the closed position requires that the oblique surface of the wedge bolt 4 be available to interface with a strike plate when necessary. Therefore, the wedge bolt 4 is configured to assume two different states, i.e., (1) both the wedge bolt 4 and the shield 8 are extended and (2) the wedge bolt 4 is extended while the shield 8 is retracted. In the present lock 2, only a single hole 70 is used to effectuate any one of the two states. Alternatively, a deadbolt may be interchangeably used with a wedge bolt. For instance, two adjacent holes are provided to accommodate a wedge bolt and a dead bolt. Only one of the bolts will be selectively extended at any time.

In yet another alternative embodiment, the wedge bolt and dead bolt are two structurally and spatially distinct components staggered in a horizontal fashion to be used with two horizontally arranged adjacent but distinct holes. In this case, in order to maintain the door frame width as a conventional door frame, the width of the wedge bolt has to be reduced thereby weakening the structural integrity of the wedge bolt. The present lock eliminates the drawbacks for these alternate embodiments by operably and functionally integrating a shield with a substantially conventional sized wedge bolt.

Figure 4:
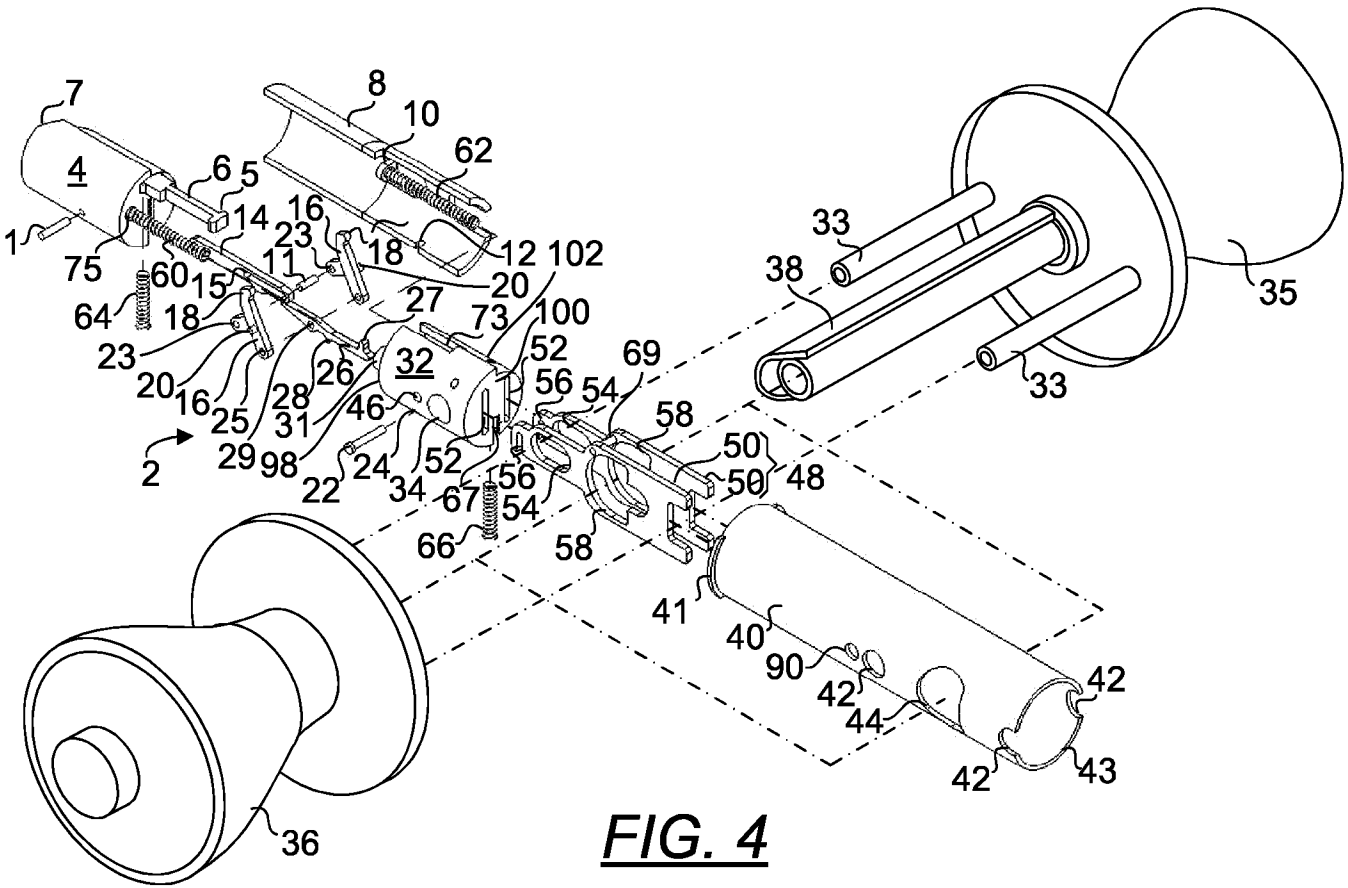
FIG. 4 is a top perspective exploded view of one embodiment of the present lock.
Figure 5:
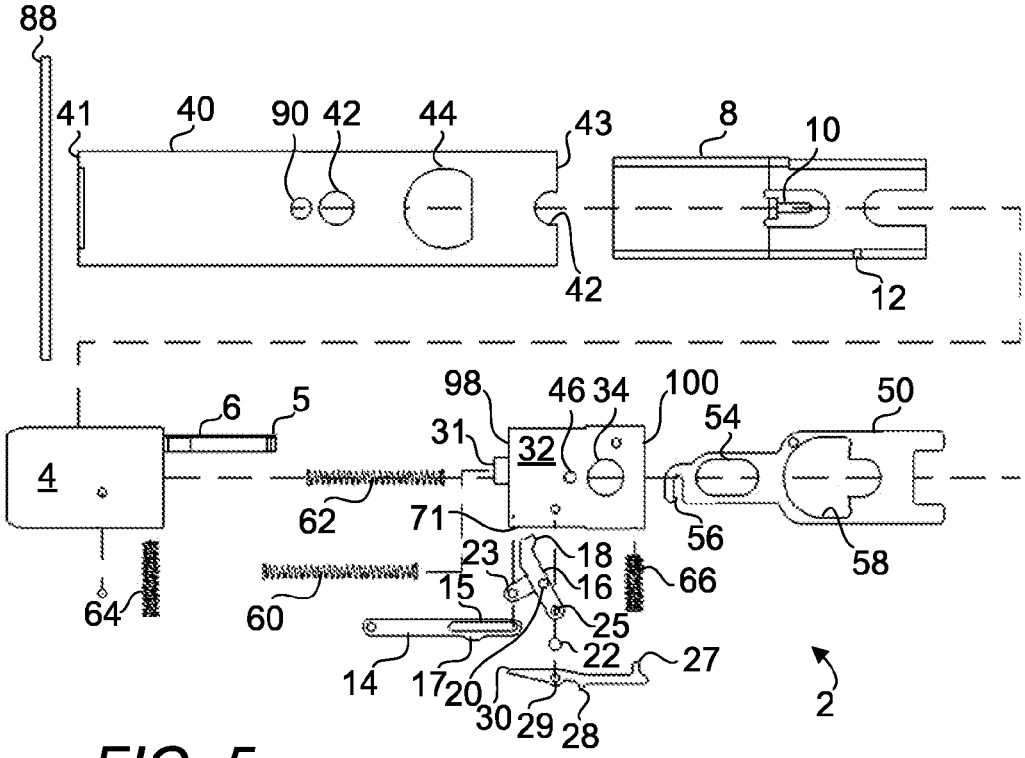
FIG. 5 is a side orthogonal exploded view of one embodiment of the present lock.
Figure 6:
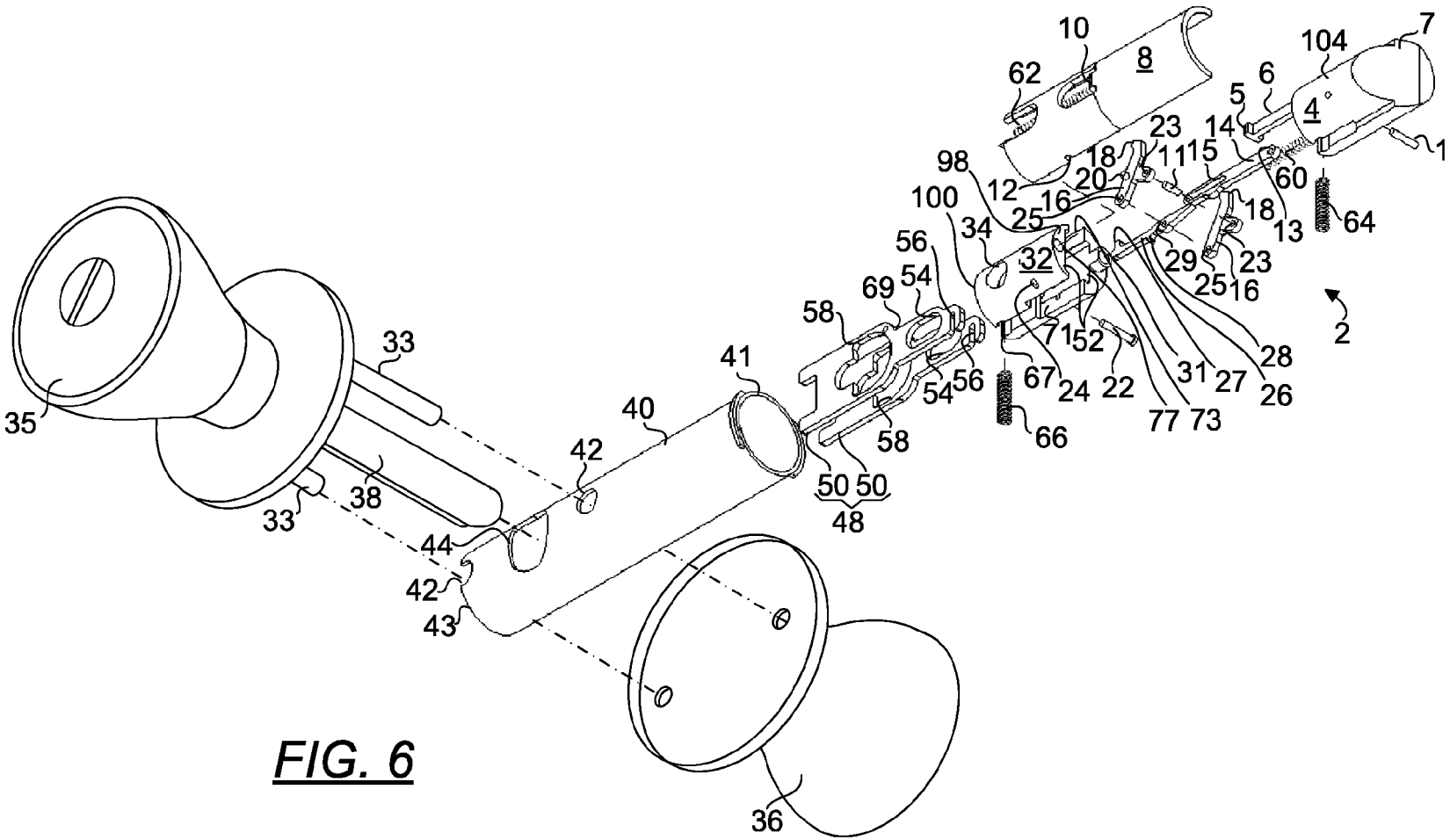
FIG. 6 is a bottom perspective exploded view of one embodiment of the present lock.

FIGS. 4, 5 and 6 are top perspective, side orthogonal and bottom perspective exploded views respectively of one embodiment of the present lock 2. The lock 2 comprises a cylindrical sleeve 40 which secure all internal moving parts of the present lock 2. A face plate (88 of FIG. 3 or 88 of FIG. 5) is fixedly attached to the proximal end 41 of the sleeve 40. In order to mount the sleeve 40, the sleeve is first inserted in an elongated cavity 86 created in the door 72 with the distal end 43 of the lock sleeve 40 first. The lock sleeve comprises two apertures 42 for accommodating support posts 33 and an aperture 44 for accommodating the door knob actuator 38. The face plate 88 is secured by means of screws or other fastening means to an edge of door 72. There is further provided a stationary block 32 which is fixedly secured to the sleeve 40. The stationary block 32 is essentially a cylindrical block having various features built into it and is secured by threading a screw through aperture 90 and fastening the screw in the threaded aperture 46 of the stationary block 32. The stationary block 32 comprises two through slots 52, a front end and 98 a rear end 100. The two through slots 52 connect the front end 98 to the rear end 100. The front end 98 of the stationary block 32 includes a spring locator 31 for receiving a spring 60 that connects the wedge bolt 4 to the stationary block 32. The stationary block 32 further comprises a slot 73 disposed on its front end 98 that is configured to receive a spring 62 that connects a shield 8 to stationary block 32. A slot 77 longitudinally disposed along a portion of the outer surface of the stationary block 32 is configured to receive the arm 6 and the retainer 5.

A pawl rocker 26 is pivotably connected to the stationary block 32 at aperture 29. A groove 71 (not visible in FIG. 4, see FIGS. 5 and 6) disposed along a lengthwise portion of the stationary block 32 accommodates the pawl rocker 26 and two rockers 16 flanking the pawl rocker 26 such that during operation, the pawl rocker 26 and two rockers 16 are substantially contained within the lengthwise surface of the stationary block 32. In the embodiment shown, a pin 22 is configured to be press fit into one end of aperture 24 of the stationary block 32 and subsequently through an aperture 25 of a first rocker 16, an aperture 29 of pawl rocker 26, an aperture 25 of a second rocker 16 and then to other end of aperture 24 to form pivotal connection 21 (see FIGS. 7, 8, 9 and 10). A transversely disposed slot 67 is configured to receive a spring 66 that connects the pawl rocker 26 at a spring locator 27 to the stationary block 32. A ramp 30 (see FIG. 5) whose function will be described elsewhere in the document is disposed at the opposite end of the pawl rocker 26 from the spring locator 27. The stationary block 32 further comprises a transversely disposed through hole 34 for receiving a support post 33 of the outside door knob 35. A portion of the curved surface of the stationary block 32 is recessed to make room for accommodating a portion of the shield 8 such that the shield 8 complements the recessed portion 102 of the stationary block 32 to maintain the substantially cylindrical shape of the shield-stationary block assembly.

The present lock 2 further comprises a retractor 48 including a pair of retractor plates 50. The retractor plates 50 are laterally offset and fixedly connected together by a pin 69. Each retractor plate 50 includes a hook 56 on a tail end and an aperture 58 for receiving a door knob actuator 38 on a head end. The tail end of each retractor plate 50 is configured for insertion in a through slot 52 of the stationary block 32 such that the tail end of the retractor plate 50 is disposed on the front end of the stationary block 32. An aperture 54 is disposed between the hook 56 and the aperture 58 to accommodate the door knob actuator 38.

The present lock 2 further comprises a pair of rockers 16. Each rocker 16 comprises a bar having a horn 18 on one end and an aperture 25 on the opposing end from the horn 18. A rocker pin 20 is disposed between the horn 18 and the aperture 25 and another aperture 23 is disposed in a triangular relationship between the apertures 25, 23 and the horn 18. A pin 11 fixedly secures the pair of rockers 16 such that they are configured to rotate about an axis through aperture 25 in unison. Each rocker 16 is a mirror image of the other about pin 11.

The present lock 2 further comprises a horizontal bar 14 including a pivot end and a sliding end, a hump 17 and a guide slot 15. During assembly, pin 11 must first be placed transversely with respect to the horizontal bar 14 within the guide slot 15. In the present embodiment, the pin 11 is then press fit into the apertures 25 of the rockers 16. Each rocker pin 20 is pivotably coupled to a hook 56 of a retractor plate 50. The horizontal bar 14 further comprises an aperture 13 (see FIGS. 7, 8, 9, 10) configured to be pivoted to the wedge bolt 4 using pin 1. The wedge bolt 4 is essentially a cylinder having a first end, a second end and an oblique surface disposed on the first end, a slot 75 for receiving a spring 60 on the second end, an arm 6 extending from the second end of the wedge bolt 4 and a retainer 5 flaring from the free end of the arm 6. A portion of the curved surface of the wedge bolt 4 is recessed to make room for accommodating another portion of the shield 8 such that the shield 8 complements the recessed portion 104 of the wedge bolt 4 to maintain the substantially cylindrical shape of the shield-wedge bolt assembly. The shield 8 is essentially a lengthwise portion of a cylinder. A seat 10 is fixedly attached on an inside surface of the shield 8 to serve both as a spring locator and the shield's travel limit against the wedge bolt 4. There is further provided a recess 12 that is configured to cooperate with the pawl 28 so as to maintain the shield 8 in its retracted position. Spring 62 is mounted at one end to the seat 10 while inserted at the other end to the slot 73 of the stationary block 32. The arm 6 is disposed such that it lodges between a space formed between the horns 18 of the rockers 16 and the retainer 5 comes in contacting engagement with the horns 18.

As the retractor 48 is pulled in a direction away from the stationary block 32, the hooks 56 engage the rocker pins 20 which in turn cause the rockers 16 to rotate about an axis formed by the apertures 24, 25 and 29, thereby pulling the wedge bolt 4 against spring 60 in the direction towards the stationary block 32. As the retractor is released, the resilience of spring 60 returns the wedge bolt 4 to its extended position.

Having laid out the various components of the present lock 2, the operations of the present lock 2 will be explained in conjunction with the ensuing figures. FIGS. 7-10 show cutaway views of the inner workings of an assembled lock 2. Some components are not shown in order to more clearly reveal the relationships and placements of critical components to aid in understanding of the various states the lock 2. Door knobs are also not shown in order that focus be made on the inner mechanisms of the lock 2. In an effort to explain the following figures, references may also be made back to previously described figures as if the various components of separate Figures are put in the same context.

Figure 7:
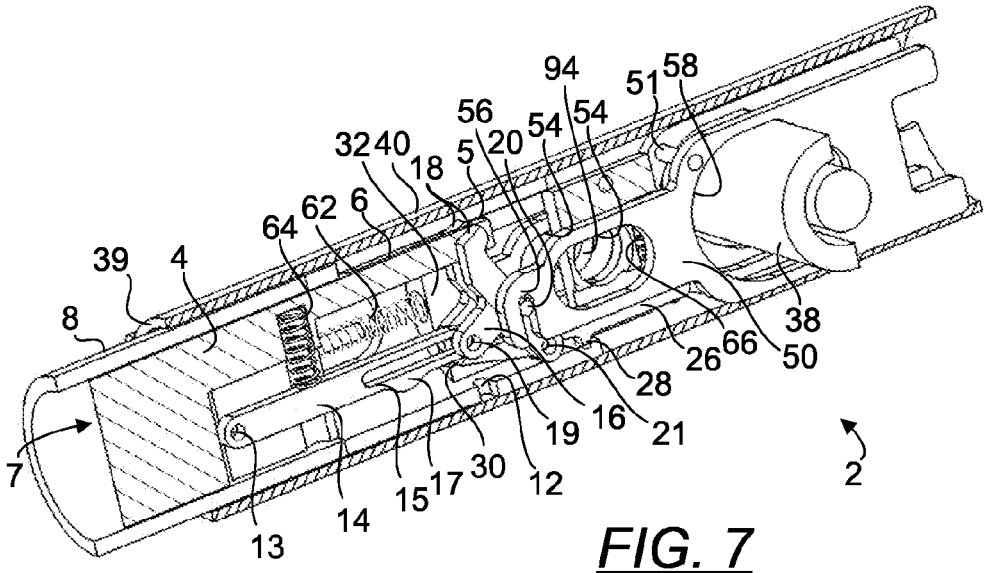
FIG. 7 is a top perspective sectional view of one state of one embodiment of the present lock depicting both the wedge bolt and shield in their extended position.

FIG. 7 is a top perspective sectional view of one state of one embodiment of the present lock depicting both the wedge bolt 4 and shield 8 in their extended position. This state is the result of having released the pawl 28 from the recess 12 of shield 8. The spring 62 which connects the shield 8 to the stationary block 32 is sprung to bring the shield 8 to its extended position. As explained elsewhere, the limit to which the shield 8 is extended corresponds to the extended position of the wedge bolt 4. FIG. 7 depicts a door knob actuator 38 that is not actuated. In this position, the spring 60 (removed from FIG. 7 to reveal the inner workings of the lock 2) connecting the stationary block 32 to the wedge bolt 4 is extended. It shall be noted that both the shield 8 and the wedge bolt 4 extend well beyond the exposed end 39 of the lock sleeve 40. The travel of the wedge bolt 4 is however limited by the retainer 5 at the tip of arm 6. In this extended position, the shield 8 prevents access to the oblique surface of the wedge bolt 4 while seated in a hole in a door frame.

Figure 8:
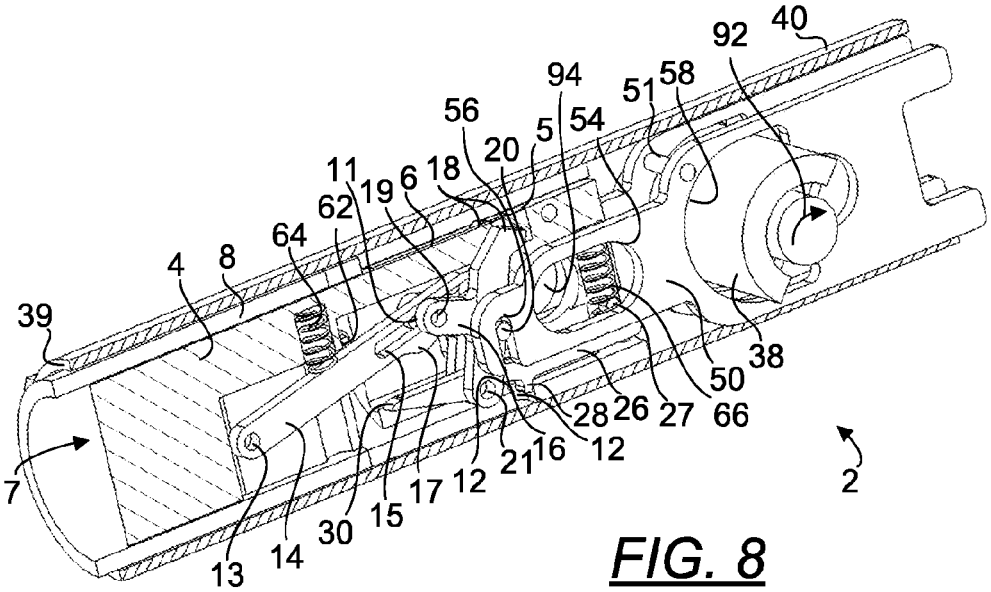
FIG. 8 is a top perspective sectional view of one state of one embodiment of the present lock depicting both the wedge bolt and shield in their retracted position.

FIG. 8 is a top perspective sectional view of one state of one embodiment of the present lock depicting both the wedge bolt 4 and shield 8 in their retracted position. This position is the result of an act of turning the door knob 35, 36 in direction 92 as it shall be noted that the door knob actuator 38 is now positioned at an angle as compared to the position of the door knob actuator 38 in FIG. 7. This act is typically associated with opening a door. It shall be noted that pin 11 of the rockers 16 is now raised, which in turn raises the horizontal bar 14. The shield 8 is pulled back to its retracted position such that the pawl 28 aligns with the recess 12 and spring 66 urges the pawl 28 to engage with the recess 12. In this position, the hump 17 of the horizontal bar 14 stays well clear from interacting with the pawl rocker 26 so that the shield 8 will stay in the retracted position upon release of the door knob actuator 38. In order to accommodate the horizontal bar 14 disposed in a position to clear the pawl rocker 26 while the wedge bolt 4 is being retracted, pin 11 is configured to glide along guide slot 15. Upon releasing the door knob actuator 38 depicted in FIG. 6 after having cleared the hole 70 and strike plate 68, the lock 2 will assume a state depicted in FIG. 9. Spring 64 is configured to push against a portion of the horizontal bar 14 urging it to rotate about aperture 13 in a direction towards the pawl rocker 26. It shall be noted that a clearance 94 is provided for a support post to go through.

Figure 9:
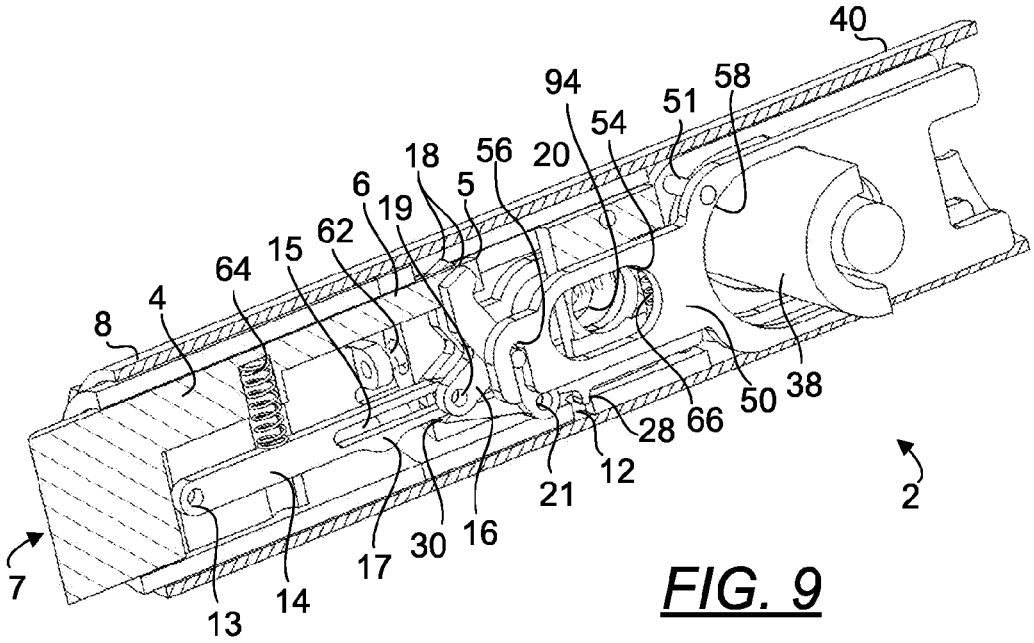
FIG. 9 is a top perspective sectional view of one state of one embodiment of the present lock depicting the wedge bolt in its extended position and the shield in its retracted position.

FIG. 9 is a top perspective sectional view of one state of one embodiment of the present lock depicting the wedge bolt 4 in its extended position and the shield 8 in its retracted position. As the door knob actuator 38 is released, spring 60 (not shown in FIGS. 7-10) causes the wedge bolt 4 to extend to its extended position, allowing the rockers 16 to rotate about pivotal connection 21. As the wedge bolt 4 extends and the rockers 16 rotate, spring 64 urges the horizontal bar 14 to assume an orientation substantially parallel to the wedge bolt 4. It shall be noted that, while in its current position, clearance 94 is maintained. This state is necessary as access to the oblique surface 7 of the wedge bolt 4 is required so that the wedge bolt 4 may interact with the strike plate 68 to properly slow down a door from a closing action and to engage its corresponding door frame by providing the ability to extend and retract as required. Without this access, the wedge bolt 4 will not retract as required as the shield 8 would receive an impact with the strike plate 68 first as a door is being closed.

Figure 10:
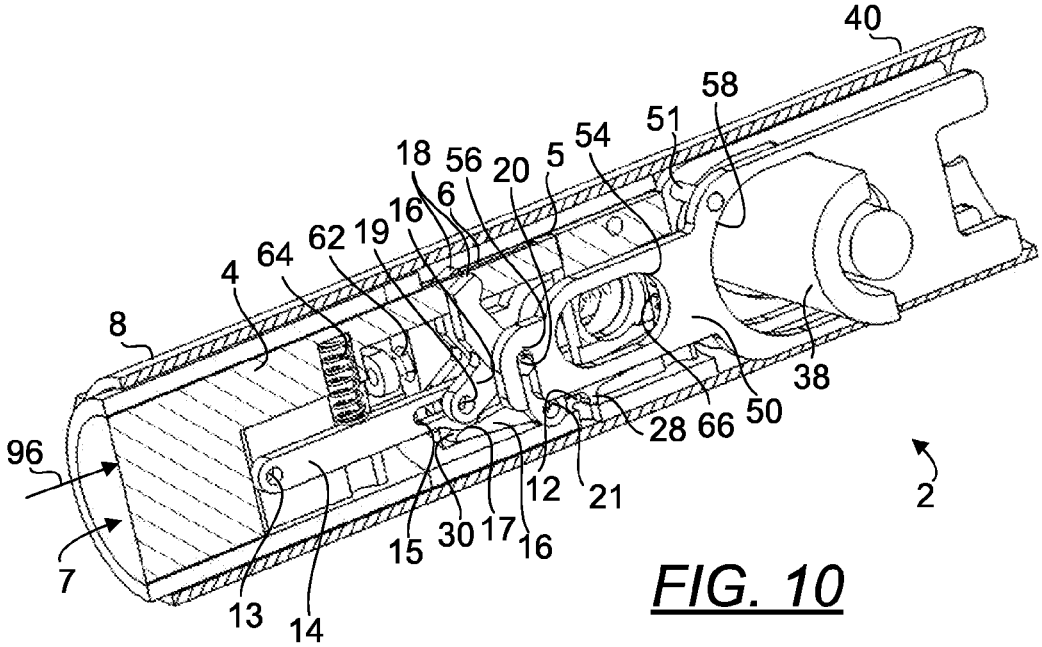
FIG. 10 is a top perspective sectional view of one state of one embodiment of the present lock depicting the wedge bolt returned to its retracted position.

FIG. 10 is a top perspective sectional view of one state of one embodiment of the present lock depicting the wedge bolt 4 returned to its retracted position as a result of a force exerted on the wedge bolt 4 by a strike plate in direction 96, i.e., the direction in which the wedge bolt 4 or the shield 8 retracts. As the wedge bolt 4 retracts, it pushes the horizontal bar 14 towards the pawl rocker 26. The hump 17 subsequently impacts the ramp 30 of the pawl rocker 26. The hump 17 then rides on top of the pawl rocker 26 such that the pawl rocker 26 rotates about pivotal connection 21 until the pawl 28 disengages from the recess 12. At this moment, the shield 8 is free to extend from its retracted position to assume the position depicted in FIG. 7. Upon reaching the hole 70 of a door frame as depicted in FIG. 3, the shield 8 extends as it is no longer held back by the pawl 28.

We claim:

1. A tamper proof lock mountable to a door, wherein the door has an outside end, an inside end and a door frame having a hole and a strike plate, wherein the strike plate is mounted to a portion of the door frame, said lock comprising:

a. a wedge bolt having a first end, a second end and an oblique surface disposed on said first end of said wedge bolt, said oblique surface is accessible from the outside end of the door and said second end of said wedge bolt is movably secured to the door, whereby if said oblique surface comes in contacting engagement with the strike plate, said wedge bolt becomes retracted in the door and if said oblique surface clears the contacting engagement and becomes aligned with the hole, said wedge bolt becomes extended from the door and seated in the hole to retain the door in its closed position; and b. a shield having a first end, a second end, said second end of said shield is configured to be movably secured to the door, said first end of said shield is substantially parallelly disposed to said wedge bolt, whereby when said wedge bolt becomes extended and seated in the hole, said first end of said shield is configured to extend and block at least a portion of said oblique surface against an attempt to access said oblique surface approaching from the outside end.

2. The tamper proof lock of claim 1, wherein said shield cooperates with said wedge bolt to complement said oblique surface of said wedge bolt such that said oblique surface is removed when said wedge bolt is disposed in the hole.

3. A tamper proof lock mountable to a door having a door knob actuator, a door frame and a strike plate with a hole, wherein the strike plate is mounted to a portion of the door frame, said lock comprising:

a. a wedge bolt having a retracted position, an extended position, an oblique surface on a first end, an arm opposingly disposed on a second end and a return spring;

b. a shield having a retracted position, an extended position and a recess;

c. a stationary block having at least one through slot, a front end and a rear end, wherein said at least one through slot connects said front end to said rear end and said second end of said wedge bolt is springingly connected to said front end of said stationary block and said shield is springingly connected to said front end of said stationary block;

d. a horizontal bar having a pivot end and a sliding end, wherein said horizontal bar includes a hump and said return spring of said wedge bolt is configured to urge said horizontal bar to a triggering position; and e. a pawl rocker comprising a lever having a trigger end, a pawl, a spring, a spring end and a third pivot point, wherein a ramp is disposed on said trigger end and configured for momentary engagement with said hump of said horizontal bar, said pawl is configured to engage said recess of said shield and opposingly disposed from said trigger end about said third pivot point and said spring urges said pawl rocker at said spring end to cause tendency of said pawl to engage said recess, wherein when said shield is disposed in a retracted position, said wedge bolt is configured to momentarily engage the strike plate and retract said wedge bolt such that said hump of said horizontal bar momentarily engages said ramp of said pawl rocker, thereby rocking said pawl rocker about said third pivot point, releasing said pawl from said recess and causing said shield to be sprung into said extended position in the hole of the strike plate.

4. The tamper proof lock of claim 3, further comprising:

a. a retractor having at least one retractor plate, wherein said at least one retractor plate includes a hook on a tail end and an aperture for receiving the door knob actuator on a head end and said tail end of said at least one retractor plate is configured for insertion in said at least one through slot of said stationary block such that said tail end is disposed on said front end of said stationary block; and b. at least one rocker comprising a bar having a horn on one end and a first pivot point on an opposing end, an axis of rotation about said first pivot point, a second pivot point and a pin disposed substantially parallel to said axis of rotation and between said horn and said first pivot point and said pin is pivotably coupled to said hook of said at least one retractor plate, wherein said shield further comprises a seat configured to be engaged in the direction from said shield to said stationary block, said horizontal bar further comprises a guide slot disposed on said sliding end of said horizontal bar, said arm of said wedge bolt further comprises a retainer, said third pivot point is pivotably connected to said second pivot point and a rotation of the door knob actuator retracts said at least one retractor from said front end of said stationary block to said rear end of said stationary block, thereby rotating said rocker about said third pivot point, engaging and pulling said horn of said at least one rocker springingly against said retainer of said wedge bolt, retracting said shield to its retracted position such that said pawl engages said recess and said pawl retains said shield in said retracted position.

* * * * *